US010294569B2

(12) United States Patent
Lifschitz Arribio et al.

(10) Patent No.: US 10,294,569 B2
(45) Date of Patent: May 21, 2019

(54) STABLE ELECTROLESS COPPER PLATING COMPOSITIONS AND METHODS FOR ELECTROLESS PLATING COPPER ON SUBSTRATES

(71) Applicant: Rohm and Haas Electronic Materials LLC, Marlborough, MA (US)

(72) Inventors: Alejo M. Lifschitz Arribio, Wallham, MA (US); Donald E. Cleary, Littleton, MA (US)

(73) Assignee: Rohm and Haas Electronic Materials LLC, Marlborough, MA (US)

( * ) Notice: Subject to any disclaimer, the term of this patent is extended or adjusted under 35 U.S.C. 154(b) by 0 days.

(21) Appl. No.: 16/034,700

(22) Filed: Jul. 13, 2018

(65) Prior Publication Data

US 2019/0106792 A1 Apr. 11, 2019

Related U.S. Application Data

(60) Provisional application No. 62/568,820, filed on Oct. 6, 2017.

(51) Int. Cl.

| | |
|---|---|
| ***C23C 18/40*** | (2006.01) |
| ***C23C 18/18*** | (2006.01) |
| ***C23C 18/30*** | (2006.01) |

(52) U.S. Cl.

CPC ..... *C23C 18/40* (2013.01); *C23C 18/18* (2013.01)

(58) Field of Classification Search

None

See application file for complete search history.

(56) References Cited

U.S. PATENT DOCUMENTS

| | | | | |
|---|---|---|---|---|
| 3,234,031 | A * | 2/1966 | Zirngiebl | D06M 11/83 427/443.1 |
| 3,361,580 | A | 1/1968 | Schneble, Jr. et al. | |
| 3,615,737 | A * | 10/1971 | Schneble, Jr. | C23C 18/40 106/1.23 |
| 3,649,350 | A * | 3/1972 | Agens | C23C 18/40 106/1.27 |
| 3,790,392 | A | 2/1974 | Gilano | |
| 3,804,638 | A | 4/1974 | Jonker et al. | |
| 3,843,373 | A | 10/1974 | Molenaar et al. | |
| 4,171,225 | A * | 10/1979 | Molenaar | C23C 18/405 106/1.23 |
| 4,440,788 | A | 4/1984 | Terayama et al. | |
| 4,517,123 | A | 5/1985 | Iso et al. | |
| 4,684,550 | A | 8/1987 | Milius et al. | |
| 8,632,628 | B2 | 1/2014 | Kolics | |
| 2016/0348245 | A1* | 12/2016 | Jin | C23C 18/1841 |
| 2018/0209048 | A1* | 7/2018 | Qi | C09D 7/48 |

FOREIGN PATENT DOCUMENTS

| | | | |
|---|---|---|---|
| GB | 1184123 | A | 3/1970 |

OTHER PUBLICATIONS

Search report for corresponding Europe Application No. 18 19 7897 dated Jan. 18, 2019.

Search report for corresponding Europe Application No. 18 19 7807 dated Jan. 18, 2019.

* cited by examiner

*Primary Examiner* — Helene Klemanski

(74) *Attorney, Agent, or Firm* — John J. Piskorski

(57) ABSTRACT

A specific cysteine derivative is added to electroless copper plating compositions to improve the stability of the electroless copper plating compositions such that the plating activity of the electroless plating copper compositions is not compromised even when electroless plating at low plating temperatures and high stabilizer and high leached catalyst concentrations.

9 Claims, 1 Drawing Sheet

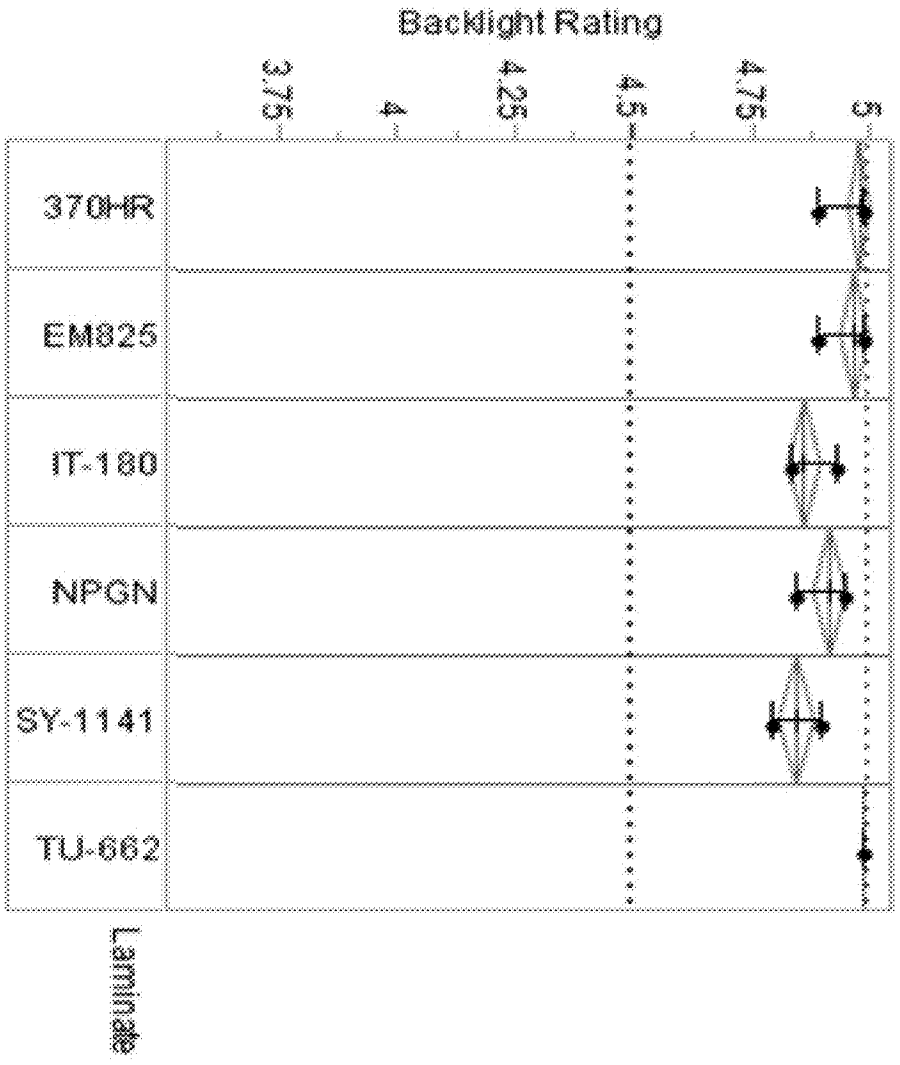
Backlight Rating
5
4.75
4.5
4.25
4
3.75
370-IR
EM825
IT-180
NPGN
SY-1141
TU-662
Laminate

STABLE ELECTROLESS COPPER PLATING COMPOSITIONS AND METHODS FOR ELECTROLESS PLATING COPPER ON SUBSTRATES

FIELD OF THE INVENTION

The present invention is directed to stable electroless copper plating compositions and methods for electroless plating copper on substrates. More specifically, the present invention is directed to stable electroless copper plating compositions and methods for electroless plating copper on substrates where the electroless copper plating compositions include a specific cysteine derivative as a stabilizer to provide stability to the electroless copper compositions without compromising electroless copper plating activity even at low plating temperatures and high stabilizer and leached catalyst concentrations.

BACKGROUND OF THE INVENTION

Electroless copper plating baths are in widespread use in metallization industries for depositing copper on various types of substrates. In the manufacture of printed circuit boards, for example, the electroless copper baths are used to deposit copper on walls of through-holes and circuit paths as a base for subsequent electrolytic copper plating. Electroless copper plating also is used in the decorative plastics industry for deposition of copper on non-conductive surfaces as a base for further plating of copper, nickel, gold, silver and other metals, as required. Electroless copper baths which are in commercial use today contain water soluble divalent copper compounds, chelating agents or complexing agents, for example, Rochelle salts and sodium salts of ethylenediamine tetraacetic acid, for the divalent copper ions, reducing agents, for example, formaldehyde, and formaldehyde precursors or derivatives, and various addition agents to make the bath more stable, adjust the plating rate and brighten the copper deposit.

It should be understood, however, that every component in the electroless copper bath has an effect on plating potential, and therefore, must be regulated in concentration to maintain the most desirable plating potential for particular ingredients and conditions of operation. Other factors which affect internal plating voltage, deposition quality and rate include temperature, degree of agitation, type and concentration of basic ingredients mentioned above.

In electroless copper plating baths, the components are continuously consumed such that the baths are in a constant state of change, thus consumed components must be periodically replenished. Control of the baths to maintain high plating rates with substantially uniform copper deposits over long periods of time is exceedingly difficult. Consumption and replenishment of bath components over several metal turnovers (MTO) can also contribute to bath instability, for example, through the buildup of side products. Therefore, such baths, and particularly those having a high plating potential, i.e. highly active baths, tend to become unstable and to spontaneously decompose with use. Such electroless copper bath instability can result in non-uniform or discontinuous copper plating along a surface. For example, in the manufacture of printed circuit boards, it is important to plate electroless copper on the walls of through-holes such that the copper deposit on the walls is substantially continuous and uniform with minimal, preferably, no break or gaps in the copper deposit. Such discontinuity of the copper deposit can ultimately lead to malfunctioning of any electrical device in which the defective printed circuit board is included. In addition, unstable electroless copper baths can also result in interconnect defects (ICDs) which can also lead to mal-functioning electrical devices.

Another issue associated with electroless copper plating is the stability of the electroless copper plating bath in the presence of high catalyst metal leaching. Electroless copper plating utilizes various metal containing catalysts, such as colloidal palladium-tin catalysts and ionic metal catalysts, to initiate the electroless copper plating process. Such metal containing catalysts can be sensitive to the plating conditions such as pH of the electroless copper bath, electroless plating temperature, components and concentrations of the components in the electroless copper baths, wherein such parameters can result in at least metal leaching from the catalyst, thus further destabilizing the electroless copper bath.

To address the foregoing stability issues, various chemical compounds categorized under the label "stabilizers" have been introduced to electroless copper plating baths. Examples of stabilizers which have been used in electroless copper plating baths are sulfur containing compounds, such as disulfides and thiols. Although such sulfur containing compounds have shown to be effective stabilizers, their concentrations in electroless copper baths must be carefully regulated because many of such compounds are catalyst poisons. Accordingly, such sulfur-containing compounds cannot be used over wide concentration ranges without negatively affecting the electroless plating activity or rate. On the other hand, with respect to catalyst metal leaching, the more metal which leaches from the catalyst, the greater the stabilizer concentration needed to maintain the electroless copper bath stability. Catalyst metal leaching is an inevitable aspect that needs to be accounted for in terms of long-term or metal turnover (MTO) electroless copper plating performance. To address this problem, stabilizer concentrations can be increased to overcome catalyst metal leaching. When stabilizer concentrations are increased, operating temperatures of the electroless copper baths are increased to overcome the negative impact of the increased stabilizer concentrations on the plating rate. Many stabilizers lower electroless copper plating rates, and, as mentioned above, are at high concentrations catalyst poisons. Low plating rates are detrimental to electroless copper plating performance. Electroless copper plating rate is also temperature dependent, thus when high stabilizer concentrations lower the rate, increasing the plating temperature can increase the rate. However, increasing the operating temperatures can decrease the stability of the electroless copper bath by increasing the buildup of byproducts as well as reducing bath additives by side reactions, thus negating some of the effects of increasing the stabilizer concentration. As a result, in most cases the amount of stabilizer used must be a careful compromise between maintaining a high plating rate and achieving an electroless bath that is stable over a long period of time.

Therefore, there is a need for a stabilizer for electroless copper plating baths which can stabilize the electroless copper baths over broad concentration ranges without poisoning the catalyst, without affecting the plating rate or plating performance, even where there is high catalyst metal leaching, high MTO, and wherein the electroless copper plating baths enable good through-hole coverage and reduced ICDs, even at low plating temperatures.

SUMMARY OF THE INVENTION

The present invention is directed to an electroless copper plating composition including one or more sources of copper ions, S-carboxymethyl-L-cysteine, one or more complexing agents, one or more reducing agents, and, optionally, one or more pH adjusting agents, wherein a pH of the electroless copper plating composition is greater than 7.

The present invention is also directed to a method of electroless copper plating including:

a) providing a substrate comprising a dielectric;
b) applying a catalyst to the substrate comprising the dielectric;
c) applying an electroless copper plating composition to the substrate comprising the dielectric, wherein the electroless copper plating composition comprises one or more sources of copper ions, S-carboxymethyl-L-cysteine, one or more complexing agents, one or more reducing agents, and, optionally, one or more pH adjusting agents, wherein a pH of the electroless copper plating composition is greater than 7; and
d) electroless plating copper on the substrate comprising the dielectric with the electroless copper plating composition.

The S-carboxymethyl-L-cysteine enables stable electroless copper plating compositions where the electroless copper plating compositions of the present invention are stable over wide concentration ranges of S-carboxymethyl-L-cysteine and at the same time enables high and uniform plating rates of electroless plated copper over the same concentration range. A broad operating window for the stabilizer concentration means that the stabilizer concentration does not need to be carefully monitored such that the performance of the electroless copper plating composition does not substantially change regardless of how the composition components are being replenished and consumed. Further, the stabilizer of the present invention can be used over a wide concentration range without concern for poisoning the catalyst.

In addition, the S-carboxymethy-L-cysteine enables stable electroless copper plating compositions even at high leaching of palladium metal from palladium catalysts. Stability of the electroless cooper plating composition towards leached catalyst metal is proportional to the amount of stabilizer used such that the more stabilizer added, the greater the long-term stability of the electroless copper plating composition. The electroless copper plating compositions and methods of the present invention further enable good through-hole wall coverage and reduced interconnect defects (ICDs) in printed circuit boards, even over high metal turnover (MTO), and low plating temperatures. Low plating temperatures reduce consumption of electroless copper plating composition additives which occur by undesired side reactions or decompose, thus providing a more stable electroless copper plating composition, and lowers the cost of operating the electroless copper plating process.

BRIEF DESCRIPTION OF THE DRAWING

The FIGURE is a plot of the backlight performance on FR/4 glass epoxy laminates of an electroless copper plating composition of the invention containing S-carboxymethyl-L-cysteine.

DETAILED DESCRIPTION OF THE INVENTION

As used throughout this specification, the abbreviations given below have the following meanings, unless the context clearly indicates otherwise: g=gram; mg=milligram; mL=milliliter; L=liter; cm=centimeter; m=meter; mm=millimeter; μm=micron; ppm=parts per million=mg/L; M=molar; min.=minute; MTO=metal turnover; ICD=interconnect defect; ° C.=degrees Centigrade; g/L=grams per liter; DI=deionized; Pd=palladium; Pd(II)=palladium ions with a +2 oxidation state; Pd°=palladium reduced to its metal unionized state; wt %=percent by weight; $T_g$=glass transition temperature; and e.g.=example.

The terms "plating" and "deposition" are used interchangeably throughout this specification. The terms "composition" and "bath" are used interchangeably throughout this specification. The term "metal turnover (MTO)" means the total amount of replacement metal added is equal to the total amount of metal originally in the plating composition. MTO value for a particular electroless copper plating composition=total copper deposited in grams divided by the copper content in the plating composition in grams. The term "interconnect defects (ICD)" refers to a condition that can interfere with intercircuit connections in printed circuit boards such as drill debris, residues, drill smear, particles (glass and inorganic fillers) and additional copper in through-holes. All amounts are percent by weight, unless otherwise noted. All numerical ranges are inclusive and combinable in any order except where it is logical that such numerical ranges are constrained to add up to 100%.

The electroless copper plating compositions of the present invention include, preferably consist of, one or more sources of copper ions; S-carboxymethyl-L-cysteine; one or more complexing or chelating agents; one or more reducing agents; water; and, optionally, one or more surfactants, and; optionally, one or more pH adjusting agents; and any corresponding cations or anions of the foregoing components; wherein a pH of the electroless copper plating composition is greater than 7.

S-carboxymethyl-L-cysteine of the present invention has a formula:

(I)

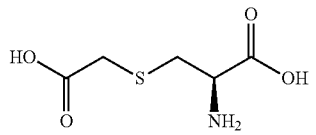

S-carboxymethyl-L-cysteine of the present invention is included in amounts of 0.5 ppm or greater, preferably, from 0.5 ppm to 200 ppm, further preferably, from 1 ppm to 50 ppm, even more preferably, from 5 ppm to 20 ppm, still more preferably, from 7 ppm to 20 ppm, further still more preferably, from 10 ppm to 20 ppm, most preferably, from 15 ppm to 20 ppm.

Sources of copper ions and counter anions include, but are not limited to, water soluble halides, nitrates, acetates, sulfates and other organic and inorganic salts of copper. Mixtures of one or more of such copper salts can be used to provide copper ions. Examples are copper sulfate, such as copper sulfate pentahydrate, copper chloride, copper nitrate, copper hydroxide and copper sulfamate. Preferably, the one or more sources of copper ions of the electroless copper plating composition of the present invention range from 0.5 g/L to 30 g/L, more preferably, from 1 g/L to 25 g/L, even more preferably, from 5 g/L to 20 g/L, further preferably, from 5 g/L to 15 g/L, and, most preferably, from 10 g/L to 15 g/L.

Complexing or chelating agents include, but are not limited to, sodium potassium tartrate, sodium tartrate, sodium salicylate, sodium salts of ethylenediamine tetraacetic acid (EDTA), nitriloacetic acid and its alkali metal salts, gluconic acid, gluconates, triethanolamine, modified ethylene diamine tetraacetic acids, S,S-ethylene diamine disuccinic acid, hydantoin and hydantoin derivatives. Hydantoin derivatives include, but are not limited to, 1-methylhydantoin, 1,3-dimethylhydantoin and 5,5-dimethylhydantoin. Preferably, the complexing agents are chosen from one or more of sodium potassium tartrate, sodium tartrate, nitriloacetic acid and its alkali metal salts, such as sodium and potassium salts of nitirloacetic acid, haydantoin and hydantoin derivatives. Preferably, EDTA and its salts are excluded from the electroless copper plating compositions of the present invention. More preferably, the complexing agents are chosen from sodium potassium tartrate, sodium tartrate, nitriloacetic acid, nitriloacetic acid sodium salt, and hydantoin derivates. Even more preferably, the complexing agents are chosen from sodium potassium tartrate, sodium tartrate, 1-methylhydantoin, 1,3-dimethylhydantoin and 5,5-dimethylhydantoin. Further preferably, the complexing agents are chosen from sodium potassium tartrate and sodium tartrate. Most preferably, the complexing agent is sodium potassium tartrate.

Complexing agents are included in the electroless copper plating compositions of the present invention in amounts of 10 g/l to 150 g/L, preferably, from 20 g/L to 150 g/L, more preferably, from 30 g/L to 100 g/L, even more preferably, from 35 g/L to 80 g/L, and, most preferably, from 35 g/l to 55 g/L.

Reducing agents include, but are not limited to, formaldehyde, formaldehyde precursors, formaldehyde derivatives, such as paraformaldehyde, borohydrides, such sodium borohydride, substituted borohydrides, boranes, such as dimethylamine borane (DMAB), saccharides, such as grape sugar (glucose), glucose, sorbitol, cellulose, cane sugar, mannitol and gluconolactone, hypophosphite and salts thereof, such as sodium hypophosphite, hydroquinone, catechol, resorcinol, quinol, pyrogallol, hydroxyquinol, phloroglucinol, guaiacol, gallic acid, 3,4-dihydroxybenzoic acid, phenolsulfonic acid, cresolsulfonic acid, hydroquinonsulfonic acid, ceatecholsulfonic acid, tiron and salts of all of the foregoing reducing agents. Preferably, the reducing agents are chosen from formaldehyde, formaldehyde derivatives, formaldehyde precursors, borohydrides and hypophosphite and salts thereof, hydroquinone, catechol, resorcinol, and gallic acid. More preferably, the reducing agents are chosen from formaldehyde, formaldehyde derivatives, formaldehyde precursors, and sodium hypophosphite. Most preferably, the reducing agent is formaldehyde.

Reducing agents are included in the electroless copper plating compositions of the present invention in amounts of 0.5 g/L to 100 g/L, preferably, from 0.5 g/L to 60 g/L, more preferably, from 1 g/L to 50 g/L, even more preferably, from 1 g/L to 20 g/L, further preferably, from 1 g/L to 10 g/L, most preferably, from 1 g/L to 5 g/L.

A pH of the electroless copper plating composition of the present invention is greater than 7. Preferably, the pH of the electroless copper plating compositions of the present invention is greater than 7.5. More preferably, the pH of the electroless copper plating compositions range from 8 to 14, even more preferably, from 10 to 14, further preferably, from 11 to 13, and most preferably, from 12 to 13.

Optionally, one or more pH adjusting agents can be included in the electroless copper plating compositions of the present invention to adjust the pH of the electroless copper plating compositions to an alkaline pH. Acids and bases can be used to adjust the pH, including organic and inorganic acids and bases. Preferably, inorganic acids or inorganic bases, or mixtures thereof are used to adjust the pH of the electroless copper plating compositions of the present invention. Inorganic acids suitable for use of adjusting the pH of the electroless copper plating compositions include, for example, phosphoric acid, nitric acid, sulfuric acid and hydrochloric acid. Inorganic bases suitable for use of adjusting the pH of the electroless copper plating compositions include, for example, ammonium hydroxide, sodium hydroxide and potassium hydroxide. Preferably, sodium hydroxide, potassium hydroxide or mixtures thereof are used to adjust the pH of the electroless copper plating compositions, most preferably, sodium hydroxide is used to adjust the pH of the electroless copper plating compositions of the present invention.

Optionally, one or more surfactants can be included in the electroless copper plating compositions of the present invention. Such surfactants include ionic, such as cationic and anionic surfactants, non-ionic and amphoteric surfactants. Mixtures of the surfactants can be used. Surfactants can be included in the compositions in amounts of 0.001 g/L to 50 g/L, preferably, in amounts of 0.01 g/L to 50 g/L.

Cationic surfactants include, but are not limited to, tetraalkylammonium halides, alkyltrimethylammonium halides, hydroxyethyl alkyl imidazoline, alkylbenzalkonium halides, alkylamine acetates, alkylamine oleates and alkylaminoethyl glycine.

Anionic surfactants include, but are not limited to, alkylbenzenesulfonates, alkyl or alkoxy naphthalene sulfonates, alkyldiphenyl ether sulfonates, alkyl ether sulfonates, alkylsulfuric esters, polyoxyethylene alkyl ether sulfuric esters, polyoxyethylene alkyl phenol ether sulfuric esters, higher alcohol phosphoric monoesters, polyoxyalkylene alkyl ether phosphoric acids (phosphates) and alkyl sulfosuccinates.

Amphoteric surfactants include, but are not limited to, 2-alkyl-N-carboxymethyl or ethyl-N-hydroxyethyl or methyl imidazolium betaines, 2-alkyl-N-carboxymethyl or ethyl-N-carboxymethyloxyethyl imidazolium betaines, dimethylalkyl betains, N-alkyl-β-aminopropionic acids or salts thereof and fatty acid amidopropyl dimethylaminoacetic acid betaines.

Preferably, the surfactants are non-ionic. Non-ionic surfactants include, but are not limited to, alkyl phenoxy polyethoxyethanols, polyoxyethylene polymers having from 20 to 150 repeating units and random and block copolymers of polyoxyethylene and polyoxypropylene.

The electroless copper compositions and methods of the present invention can be used to electroless plate copper on various substrates such as semiconductors, metal-clad and unclad substrates such as printed circuit boards. Such metal-clad and unclad printed circuit boards can include thermosetting resins, thermoplastic resins and combinations thereof, including fibers, such as fiberglass, and impregnated embodiments of the foregoing. Preferably, the substrate is a metal-clad printed circuit or wiring board with a plurality of through-holes. The electroless copper plating compositions and methods of the present invention can be used in both horizontal and vertical processes of manufacturing printed circuit boards, preferably, the electroless copper plating compositions methods of the present invention are used in horizontal processes.

Thermoplastic resins include, but are not limited to, acetal resins, acrylics, such as methyl acrylate, cellulosic resins, such as ethyl acetate, cellulose propionate, cellulose acetate butyrate and cellulose nitrate, polyethers, nylon, polyethylene, polystyrene, styrene blends, such as acrylonitrile styrene and copolymers and acrylonitrile-butadiene styrene copolymers, polycarbonates, polychlorotrifluoroethylene, and vinylpolymers and copolymers, such as vinyl acetate, vinyl alcohol, vinyl butyral, vinyl chloride, vinyl chloride-acetate copolymer, vinylidene chloride and vinyl formal.

Thermosetting resins include, but are not limited to allyl phthalate, furane, melamine-formaldehyde, phenol-formaldehyde and phenol-furfural copolymers, alone or compounded with butadiene acrylonitrile copolymers or acrylonitrile-butadiene-styrene copolymers, polyacrylic esters, silicones, urea formaldehydes, epoxy resins, allyl resins, glyceryl phthalates and polyesters.

The electroless copper plating compositions and methods of the present invention can be used to electroless copper plate substrates with both low and high $T_g$ resins. Low $T_g$ resins have a $T_g$ below 160° C. and high $T_g$ resins have a $T_g$ of 160° C. and above. Typically, high $T_g$ resins have a $T_g$ of 160° C. to 280° C. or such as from 170° C. to 240° C. High $T_g$ polymer resins include, but are not limited to, polytetrafluoroethylene (PTFE) and polytetrafluoroethylene blends. Such blends include, for example, PTFE with polypheneylene oxides and cyanate esters. Other classes of polymer resins which include resins with a high Tg include, but are not limited to, epoxy resins, such as difunctional and multifunctional epoxy resins, bimaleimide/triazine and epoxy resins (BT epoxy), epoxy/polyphenylene oxide resins, acrylonitrile butadienestyrene, polycarbonates (PC), polyphenylene oxides (PPO), polypheneylene ethers (PPE), polyphenylene sulfides (PPS), polysulfones (PS), polyamides, polyesters such as polyethyleneterephthalate (PET) and polybutyleneterephthalate (PBT), polyetherketones (PEEK), liquid crystal polymers, polyurethanes, polyetherimides, epoxies and composites thereof.

In the method of electroless copper plating with the electroless copper compositions of the present invention, optionally, the substrates are cleaned or degreased, optionally, roughened or micro-roughened, optionally, the substrates are etched or micro-etched, optionally, a solvent swell is applied to the substrates, through-holes are desmeared, and various rinse and anti-tarnish treatments can, optionally, be used.

Preferably, the substrates to be electroless copper plated with the electroless copper plating compositions and methods of the present invention are metal-clad substrates with dielectric material and a plurality of through-holes such as printed circuit boards. Optionally, the boards are rinsed with water and cleaned and degreased followed by desmearing the through-hole walls. Prepping or softening the dielectric or desmearing of the through-holes can begin with application of a solvent swell. Although, it is preferred, that the method of electroless copper plating is for plating through-hole walls, it is envisioned that the method of electroless copper plating of the present invention can also be used to electroless copper plate walls of vias.

Conventional solvent swells can be used. The specific type can vary depending on the type of dielectric material. Minor experimentation can be done to determine which solvent swell is suitable for a particular dielectric material. The $T_g$ of the dielectric often determines the type of solvent swell to be used. Solvent swells include, but are not limited to, glycol ethers and their associated ether acetates. Conventional amounts of glycol ethers and their associated ether acetates well known to those of skill in the art can be used. Examples of commercially available solvent swells are CIRCUPOSIT™ Conditioner 3302A, CIRCUPOSIT™ Hole Prep 3303 and CIRCUPOSIT™ Hole Prep 4120 solutions (available from Dow Advanced Materials).

After the solvent swell, optionally, a promoter can be applied. Conventional promoters can be used. Such promoters include sulfuric acid, chromic acid, alkaline permanganate or plasma etching. Preferably, alkaline permanganate is used as the promoter. Examples of commercially available promoters are CIRCUPOSIT™ Promoter 4130 and CIRCUPOSIT™ MLB Promoter 3308 solutions (available from Dow Advanced Materials). Optionally, the substrate and through-holes are rinsed with water.

If a promoter is used, a neutralizer is then applied to neutralize any residues left by the promoter. Conventional neutralizers can be used. Preferably, the neutralizer is an aqueous acidic solution containing one or more amines or a solution of 3 wt % hydrogen peroxide and 3 wt % sulfuric acid. An example of a commercially available neutralizer is CIRCUPOSIT™ MLB Neutralizer 216-5. Optionally, the substrate and through-holes are rinsed with water and then dried.

After neutralizing an acid or alkaline conditioner is applied. Conventional conditioners can be used. Such conditioners can include one or more cationic surfactants, non-ionic surfactants, complexing agents and pH adjusters or buffers. Examples of commercially available acid conditioners are CIRCUPOSIT™ Conditioners 3320A and 3327 solutions (available from Dow Advanced Materials). Suitable alkaline conditioners include, but are not limited to, aqueous alkaline surfactant solutions containing one or more quaternary amines and polyamines. Examples of commercially available alkaline surfactants are CIRCUPOSIT™ Conditioner 231, 3325, 813 and 860 formulations (available from Dow Advanced Materials). Optionally, the substrate and through-holes are rinsed with water.

Optionally, conditioning can be followed by micro-etching. Conventional micro-etching compositions can be used. Micro-etching is designed to provide a micro-roughened metal surface on exposed metal (e.g. innerlayers and surface etch) to enhance subsequent adhesion of plated electroless copper and later electroplate. Micro-etches include, but are not limited to, 60 g/L to 120 g/L sodium persulfate or sodium or potassium oxymonopersulfate and sulfuric acid (2%) mixture, or generic sulfuric acid/hydrogen peroxide. Examples of commercially available micro-etching compositions are CIRCUPOSIT™ Microetch 3330 Etch solution and PREPOSIT™ 748 Etch solution (both available from Dow Advanced Materials). Optionally, the substrate is rinsed with water.

Optionally, a pre-dip can then be applied to the micro-etched substrate and through-holes. Examples of pre-dips include, but are not limited to, organic salts such as sodium potassium tartrate or sodium citrate, 0.5% to 3% sulfuric acid or nitric acid, or an acidic solution of 25 g/L to 75 g/L sodium chloride.

A catalyst is then applied to the substrate. While it is envisioned that any conventional catalyst suitable for electroless metal plating which includes a catalytic metal can be used, preferably, a palladium catalyst is used in the methods of the present invention. The catalyst can be a non-ionic palladium catalyst, such as a colloidal palladium-tin catalyst, or the catalyst can be an ionic palladium catalyst. If the catalyst is a colloidal palladium-tin catalyst, an acceleration step is done using hydrochloric acid, sulfuric acid or tetrafluoroboric acid as the accelerator at 0.5-10% in water to strip tin from the catalyst and to expose the palladium metal for electroless copper plating. If the catalyst is an ionic catalyst, the acceleration step is excluded from the method and, instead, a reducing agent is applied to the substrate subsequent to application of the ionic catalyst to reduce the metal ions of the ionic catalyst to their metallic state, such as Pd (II) ions to Pd° metal. Examples of suitable commercially available colloidal palladium-tin catalysts are CIRCUPOSIT™ 3340 catalyst and CATAPOSIT™ 44 catalyst (available from Dow Advanced Materials). An example of a commercially available palladium ionic catalyst is CIRCUPOSIT™ 6530 Catalyst. The catalyst can be applied by immersing the substrate in a solution of the catalyst, or by spraying the catalyst solution on the substrate, or by atomization of the catalyst solution on the substrate using conventional apparatus. The catalysts can be applied at temperatures from room temperature to about 80° C., preferably, from about 30° C. to about 60° C. The substrate and through-holes are optionally rinsed with water after application of the catalyst.

Conventional reducing agents known to reduce metal ions to metal can be used to reduce the metal ions of the catalysts to their metallic state. Such reducing agents include, but are not limited to, dimethylamine borane (DMBH), sodium borohydride, ascorbic acid, iso-ascorbic acid, sodium hypophosphite, hydrazine hydrate, formic acid and formaldehyde. Reducing agents are included in amounts to reduce substantially all of the metal ions to metal. Such amounts are well known by those of skill in the art. If the catalyst is an ionic catalyst, the reducing agents are applied subsequent to the catalyst being applied to the substrate and prior to metallization.

The substrate and walls of the through-holes are then plated with copper using an electroless copper plating composition of the present invention. Methods of electroless copper plating of the present invention can be done at temperatures from room temperature to about 50° C. Preferably, methods of electroless copper plating of the present invention are done at temperatures from room temperature to about 46° C., more preferably, electroless copper plating is done from about 25° C. to about 40° C., even more preferably, from about 30° C. to less than 40° C., most preferably, from about 30° C. to about 36° C. The substrate can be immersed in the electroless copper plating composition of the present invention or the electroless copper plating composition can be sprayed on the substrate. Methods of electroless copper plating of the present invention using electroless copper plating compositions of the present invention are done in an alkaline environment of pH greater than 7. Preferably, methods of electroless copper plating of the present invention are done at a pH of greater than 7.5, more preferably, electroless copper plating is done at a pH of 8 to 14, even more preferably, from 10 to 14, further preferably, from 11 to 13, and most preferably, from 12 to 13.

The methods of electroless copper plating using the electroless copper plating compositions of the present invention enable good average backlight values for electroless copper plating of through-holes of printed circuit boards. Such average backlight values are preferably greater than or equal to 4.5, more preferably, from 4.65 to 5, even more preferably, from 4.8 to 5, most preferably, from 4.9 to 5. Such high average backlight values enable the methods of electroless copper plating of the present invention using the electroless copper plating compositions of the present invention to be used for commercial electroless copper plating, wherein the printed circuit board industry substantially requires backlight values of 4.5 and greater. In addition, the electroless copper plating compositions of the present invention are stable over several MTOs, preferably, from 0 MTO to 1 MTO, more preferably, from 0 MTO to 5 MTO, most preferably, from 0 MTO to 10 MTO, without requiring bath maintenance such as electroless copper plating bath dilutions or bail-out other than for replenishing compounds spent during electroless plating. Furthermore, the electroless copper plating compositions of the present invention enable reduced ICDs in laminated substrates over several MTOs, such as 0% ICDs from 2-10 MTO (e.g. 2 MTO or such as 6 MTO or such as 10 MTO). The electroless copper metal plating compositions and methods of the present invention enable uniform copper deposits over broad concentration ranges of S-carboxymethyl-L-cysteine, even with high catalyst metal leaching.

The following examples are not intended to limit the scope of the invention but to further illustrate the invention.

Example 1

Electroless Copper Composition of the Invention

The following aqueous alkaline electroless copper composition is prepared having the components and amounts disclosed in Table 1 below.

TABLE 1

| COMPONENT | AMOUNT |
|---|---|
| Copper sulfate pentahydrate | 10 g/L |
| Sodium potassium tartrate | 40 g/L |
| Sodium hydroxide | 8 g/L |
| Formaldehyde | 4 g/L |
| S-carboxymethyl-L-cysteine | 17.5 ppm |
| water | To 1 liter |

The pH of the aqueous alkaline electroless copper composition has a pH=12.7 at room temperature as measured using a conventional pH meter available from Fisher Scientific.

Example 2

Backlight Experiment with the Aqueous Alkaline Electroless Copper Composition of the Preset Invention Four (4) each of six (6) different FR/4 glass epoxy panels with a plurality of through-holes are provided: TUC-662, SY-1141, IT-180, 370HR, EM825 and NPGN. The panels are either four-layer or eight-layer copper-clad panels. TUC-662 is obtained from Taiwan Union Technology, and SY-1141 is obtained from Shengyi. IT-180 is obtained from ITEQ Corp., NPGN is obtained from NanYa and 370HR is obtained from Isola and EM825 is obtained from Elite Materials Corporation. The $T_g$ values of the panels range from 140° C. to 180° C. Each panel is 5 cm×12 cm.

The through-holes of each panel are treated as follows:

1. The through-holes of each panel are desmeared with CIRCUPOSIT™ Hole Prep 3303 solution for about 7 minutes at about 80° C.;
2. The through-holes of each panel are then rinsed with flowing tap water for 4 minutes;
3. The through-holes are then treated with CIRCUPOSIT™ MLB Promoter 3308 aqueous permanganate solution at about 80° C. for 10 minutes;
4. The through-holes are then rinsed for 4 minutes in flowing tap water;
5. The through-holes are then treated with a 3 wt % sulfuric acid/3 wt % hydrogen peroxide neutralizer at room temperature for 2 minutes;

6. The through-holes of each panel are then rinsed with flowing tap water for 4 minutes;
7. The through-holes of each panel are then treated with CIRCUPOSIT™ Conditioner 3325 alkaline solution for 5 minutes at about 60° C.;
8. The through-holes are then rinsed with flowing tap water for 4 minutes;
9. The through-holes are then treated with a sodium persulfate/sulfuric acid etch solution for 2 minutes at room temperature;
10. The through-holes of each panel are then rinsed with flowing DI water for 4 minutes;
11. The panels are then immersed into CIRCUPOSIT™ 6530 Catalyst which is an ionic aqueous alkaline palladium catalyst concentrate (available from Dow Electronic Materials) for 5 minutes at about 40° C., wherein the catalyst is buffered with sufficient amounts of sodium carbonate, sodium hydroxide or nitric acid to achieve a catalyst pH of 9-9.5, then the panels are rinsed with DI water for 2 minutes at room temperature;
12. The panels are then immersed into a 0.6 g/L dimethylamine borane and 5 g/L boric acid solution at about 30° C. for 2 minutes to reduce the palladium ions to palladium metal, then the panels are rinsed with DI water for 2 minutes;
13. The panels are then immersed in the electroless copper plating composition of Table 1 above and copper is plated at about 35° C., at a pH of 12.7 and copper is deposited on the walls of the through-holes for 5 minutes;
14. The copper plated panels are then rinsed with flowing tap water for 4 minutes;
15. Each copper plated panel is then dried with compressed air; and
16. The walls of the through-holes of the panels are examined for copper plating coverage using the backlight process described below.

Each panel is cross-sectioned nearest to the centers of the through-holes as possible to expose the copper plated walls. The cross-sections, no more than 3 mm thick from the center of the through-holes, are taken from each panel to determine the through-hole wall coverage. The European Backlight Grading Scale is used. The cross-sections from each panel are placed under a conventional optical microscope of SOX magnification with a light source behind the samples. The quality of the copper deposits are determined by the amount of light visible under the microscope that is transmitted through the sample. Transmitted light is only visible in areas of the plated through-holes where there is incomplete electroless coverage. If no light is transmitted and the section appears completely black, it is rated a 5 on the backlight scale indicating complete copper coverage of the through-hole wall. If light passes through the entire section without any dark areas, this indicates that there is very little to no copper metal deposition on the walls and the section was rated 0. If sections have some dark regions as well as light regions, they are rated between 0 and 5. A minimum of ten through-holes are inspected and rated for each board.

The FIGURE is a backlight rating distribution graph showing the backlight performance of the aqueous alkaline copper plating composition of the present invention. The plots in the graph indicate a 95% confidence interval for the backlight ratings of ten through-holes sectioned for each board. The horizontal line through the middle of each plot indicates the average backlight value for each group of ten through-hole sections measured. Backlight values of 4.5 and greater are indicative of commercially acceptable catalysts in the plating industry. The through-holes of the 370HR panels have average backlight values of 4.9 to 5, NPGN have average values of 4.8 to 4.9, SY-1141 have an average value of 4.8, EM825 average values of 4.9 to 5, IT-180 average values of 4.8 to 4.9 and TU-662 an average value 5. All of the backlight values show commercially acceptable values for the various FR/4 glass-epoxy panels.

Example 3

ICD Experiments at Multiple MTOs with the Aqueous Alkaline Electroless Copper Plating Composition of the Present Invention A plurality of six different multi-layer, copper-clad FR/4 glass-epoxy panels with a plurality of through-holes are provided as in Example 2: TUC-662, SY-1141, IT-180, 370HR, EM825 and NPGN. The through-holes of each panel are treated as follows:

1. The through-holes of each panel are desmeared with CIRCUPOSIT™ Hole Prep 3303 solution for 7 minutes at about 80° C.;
2. The through-holes of each panel are then rinsed with flowing tap water for 4 minutes;
3. The through-holes are then treated with CIRCUPOSIT™ MLB Promoter 3308 aqueous permanganate solution at about 80° C. for 10 minutes;
4. The through-holes are then rinsed for 4 minutes in flowing tap water;
5. The through-holes are then treated with a 3 wt % sulfuric acid/3 wt % hydrogen peroxide neutralizer at room temperature for 2 minutes;
6. The through-holes of each panel are then rinsed with flowing tap water for 4 minutes;
7. The through-holes of each panel are then treated with CIRCUPOSIT™ Conditioner 3320A alkaline solution for 5 minutes at about 45° C.;
8. The through-holes are then rinsed with flowing tap water for 4 minutes;
9. The through-holes are then treated with sodium persulfate/sulfuric acid etch solution for 2 minutes at room temperature;
10. The through-holes of each panel are then rinsed with flowing DI water for 4 minutes;
11. The panels are then immersed into CIRCUPOSIT™ 6530 Catalyst which is an ionic aqueous alkaline palladium catalyst concentrate (available from Dow Electronic Materials) for 5 minutes at about 40° C., wherein the catalyst is buffered with sufficient amounts of sodium carbonate, sodium hydroxide or nitric acid to achieve a catalyst pH of 9-9.5, then the panels are rinsed with DI water for 2 minutes at room temperature;
12. The panels are then immersed into a 0.6 g/L dimethylamine borane and 5 g/L boric acid solution at about 30° C. for 2 minutes to reduce the palladium ions to palladium metal, then the panels are rinsed with DI water for 2 minutes;
13. The panels are then immersed in the electroless copper plating composition of Table 1 above and copper is plated at about 36° C., at a pH of 12.7 and copper is deposited on the walls of the through-holes for 5 minutes at 2 MTO, 6 MTO and 10 MTO;
14. The copper plated panels are then rinsed with flowing tap water for 4 minutes;

15. Each copper plated panel is then dried with compressed air; and
16. The walls of the through-holes of the panels are examined for ICDs using the following procedure: The through-hole panels are submerged in a pH 1 hydrochloric acid solution for 2 minutes to remove any oxide; copper is then electroplated onto the through-hole parts to an electrolytic copper thickness of 20 μm; the panels are then rinsed with flowing tap water for 10 minutes and baked in an oven at about 125° C. for 6 hours; after baking, the through-hole panels are thermally stressed by exposing them to six, 10 second cycles of thermal expansion by placing them in a sot solder bath at about 288° C.; following thermal stress, the panels are embedded onto an epoxy resin, the resin is cured, and the coupons are cross-sectioned and polished nearest to the centers of the through-holes to expose the copper plated walls; the coupons embedded in the resin are then etched with an ammonium hydroxide/hydrogen peroxide aqueous mixture to expose the contacts between the copper inner-layers in the laminate, the electroless copper layer, and the electrolytic copper layer; and, the cross-sections from each panel are placed under a conventional optical microscope of 200× magnification and the contacts between the different copper layers are inspected.

In total, 312 contacts per laminate material are inspected for ICDs. An ICD is a separation between the electroless copper layer and the copper inner layer in the laminate, or between the electroless copper layer and the electrolytic copper layer. The total amount of contacts showing ICDs per laminate is reported in Table 2 as a percentage of the total amount of contacts examined Table 2 below discloses the average (mean) number of ICDs for each panel tested.

TABLE 2

| Number of Panels Tested | Panel Type | 2 MTO | 6 MTO | 10 MTO |
|---|---|---|---|---|
| 42 | TU-662 | 0% | 0% | 0% |
| 44 | SY-1141 | 0% | 0% | 0% |
| 45 | NPGN | 0% | 0% | 0% |
| 47 | IT-180 | 0% | 0% | 0% |
| 48 | 370HR | 0% | 0% | 0% |
| 50 | EM825 | 0% | 0% | 0% |

None of the through-holes of the panels show any indication of ICDs after electroless plating with the aqueous alkaline cooper composition of the invention over 2 MTO, 6 MTO and 10 MTO.

Example 4

Copper Plating Rate of an Electroless Copper Composition of the Present Invention Vs. an Electroless Conventional Copper Plating Composition Containing 2,2'-Thiodiglycolic Acid The following aqueous alkaline electroless copper plating compositions of the invention are prepared.

TABLE 3

| (Invention) | | | | | | | | |
|---|---|---|---|---|---|---|---|---|
| Component | Bath 1 | Bath 2 | Bath 3 | Bath 4 | Bath 5 | Bath 6 | Bath 7 | Bath 8 |
| Copper Sulfate Pentahydrate | 10 g/L | 10 g/L | 10 g/L | 10 g/L | 10 g/L | 10 g/L | 10 g/L | 10 g/L |
| Sodium potassium tartrate | 40 g/L | 40 g/L | 40 g/L | 40 g/L | 40 g/L | 40 g/L | 40 g/L | 40 g/L |
| Sodium hydroxide | 8 g/L | 8 g/L | 8 g/L | 8 g/L | 8 g/L | 8 g/L | 8 g/L | 8 g/L |
| Formaldehyde | 4 g/L | 4 g/L | 4 g/L | 4 g/L | 4 g/L | 4 g/L | 4 g/L | 4 g/L |
| S-carboxymethyl-L-cysteine | 1 ppm | 2.5 ppm | 5 ppm | 7.5 ppm | 10 ppm | 12.5 ppm | 15 ppm | 20 ppm |

The following comparative aqueous alkaline electroless copper plating compositions are prepared.

TABLE 4

| (Comparative) | | | | | | | | |
|---|---|---|---|---|---|---|---|---|
| Component | Bath 9 | Bath 10 | Bath 11 | Bath 12 | Bath 13 | Bath 14 | Bath 15 | Bath 16 |
| Copper Sulfate Pentahydrate | 10 g/L | 10 g/L | 10 g/L | 10 g/L | 10 g/L | 10 g/L | 10 g/L | 10 g/L |
| Sodium potassium tartrate | 40 g/L | 40 g/L | 40 g/L | 40 g/L | 40 g/L | 40 g/L | 40 g/L | 40 g/L |
| Sodium hydroxide | 8 g/L | 8 g/L | 8 g/L | 8 g/L | 8 g/L | 8 g/L | 8 g/L | 8 g/L |

TABLE 4-continued

| (Comparative) | | | | | | | | |
|---|---|---|---|---|---|---|---|---|
| Component | Bath 9 | Bath 10 | Bath 11 | Bath 12 | Bath 13 | Bath 14 | Bath 15 | Bath 16 |
| Formaldehyde | 4 g/L | 4 g/L | 4 g/L | 4 g/L | 4 g/L | 4 g/L | 4 g/L | 4 g/L |
| 2,2'-thioglycolic acid | 1 ppm | 2.5 ppm | 5 ppm | 7.5 ppm | 10 ppm | 12.5 ppm | 15 ppm | 20 ppm |

Each bath is used to electroless copper plate an FR/4 glass-epoxy laminate of NPGN material and stripped of copper cladding. The laminate pieces are all 5 cm by 10 cm in size. Prior to electroless plating, the stripped laminates are baked for 1 hour at about 125° C. and the weight of the laminate is recorded prior to electroless plating. The pH of the electroless copper baths are 12.7 at room temperature and the plating temperature is about 36° C. Electroless copper plating is done for 5 minutes.

After plating for 5 minutes the substrates are removed from the plating baths, rinsed with DI water for 2 minutes and baked at about 125° C. for 1 hour. The thickness of the copper deposits are determined by measuring the final weight of the baked panel and converting the weight gain to deposit thickness taking the panel area and electroless copper thickness density into account. The rate is calculated by dividing the thickness over the amount of electroless plating time, resulting in a rate value expressed in μm/min

TABLE 5

| (Invention) Copper Plating Rate from Electroless Copper Baths of the Present Invention | |
|---|---|
| BATH # | COPPER THICKNESS |
| Bath 1 | 0.14 μm/min |
| Bath 2 | 0.14 μm/min |
| Bath 3 | 0.14 μm/min |
| Bath 4 | 0.14 μm/min |
| Bath 5 | 0.14 μm/min |
| Bath 6 | 0.14 μm/min |
| Bath 7 | 0.14 μm/min |
| Bath 8 | 0.14 μm/min |

TABLE 6

| (Comparative) Copper Plating Rate from Conventional Comparative Electroless Copper Baths with 2,2'-thiodiglycolic Acid | |
|---|---|
| BATH # | COPPER THICKNESS |
| Bath 9 | 0.14 μm/min |
| Bath 10 | 0.10 μm/min |
| Bath 11 | 0.10 μm/min |
| Bath 12 | 0.10 μm/min |
| Bath 13 | 0.09 μm/min |
| Bath 14 | 0.10 μm/min |
| Bath 15 | 0.09 μm/min |
| Bath 16 | 0.08 μm/min |

The electroless copper plating results show that the electroless copper plating baths of the present invention plate substantially the same copper rate over an S-carboxymethyl-L-cysteine concentration range of 1 ppm to 20 ppm indicating a stable electroless copper bath over a wide S-carboxymethyl-L-cysteine concentration range. In contrast, the conventional comparative electroless copper plating baths show decrease in copper plating thickness as the concentration of 2,2'-thioglycolic acid increases from 1 ppm to 20 ppm, thus indicating that the concentration range wherein 2,2'-thioglycolic does not suppress plating rate is much reduced. As a result, in order to keep high plating rates at low temperature, lower amounts of 2,2'-thioglycolic must be used as opposed to S-carboxymethyl-L-cysteine, making compositions containing 2,2'-thioglycolic less stable than those that contain the S-carboxymethyl-L-cysteine.

Example 5

Electroless Copper Bath Stability and Palladium Metal Loading

The following two electroless copper plating baths are prepared.

TABLE 7

| COMPONENT | BATH 17 | BATH 18 |
|---|---|---|
| Copper Sulfate Pentahydrate | 10 g/L | 10 g/L |
| Sodium potassium tartrate | 40 g/L | 40 g/L |
| Sodium hydroxide | 8 g/L | 8 g/L |
| Formaldehyde | 4 g/L | 4 g/L |
| S-carboxymethyl-L-cysteine | 20 ppm | — |
| 2,2'-thioglycolic acid | — | 1.5 ppm |

The pH of each bath=12.7 and the temperatures of the baths at the time of make-up are at room temperature.

Each bath is used to electroless copper plate FR/4 glass-epoxy laminates of NPGN material stripped of copper cladding. Electroless copper plating is done for 5 minutes at a pH=12.7 and at bath temperatures of about 35° C. The amount of stabilizer in each bath is determined at that concentration which can allow for a plating rate of more than 0.12 μm/min of electroless copper on the stripped panels. Colloidal palladium-tin catalysts (CATAPOSIT™ palladium-tin catalyst available from Dow Electronic Materials) are used in the electroless plating process. The amount of the catalyst is varied to provide palladium metal concentrations as shown in the table below to simulate palladium leaching from the catalyst and the tolerance of each bath for high concentrations of palladium metal.

TABLE 8

| Palladium Metal Concentration (ppm) | BATH 17 | BATH 18 |
|---|---|---|
| 0 | 0.14 μm/min | 0.14 μm/min |
| 1 | 0.14 μm/min | — |
| 2 | 0.14 μm/min | — |
| 3 | 0.14 μm/min | — |

TABLE 8-continued

| Palladium Metal Concentration (ppm) | BATH 17 | BATH 18 |
|---|---|---|
| 4 | 0.14 μm/min | — |
| 5 | 0.14 μm/min | — |
| 6 | 0.14 μm/min | — |

Bath 17 which is an aqueous alkaline electroless copper bath of the present invention shows uniform copper plating rate over the increase in palladium metal concentration in the copper bath indicating good bath stability over palladium metal leaching. In contrast, Bath 18, the comparative conventional bath, shows copper plating where the amount of palladium metal is 0 ppm. However, when the metal palladium concentration is 1 ppm or greater, the electroless bath quickly decomposes and as a result no indication of copper plating is evident on the stripped panels.

What is claimed is:

1. An electroless copper plating composition comprising one or more sources of copper ions, S-carboxymethyl-L-cysteine, one or more complexing agents, one or more reducing agents, and, optionally, one or more pH adjusting agents, wherein a pH of the electroless copper plating composition is greater than 7.

2. The electroless copper plating composition of claim 1, wherein the S-carboxymethyl-L-cysteine is in amounts of at least 0.5 ppm.

3. The electroless copper plating composition of claim 2, wherein the S-carboxymethyl-L-cysteine is in amounts of 0.5 ppm to 200 ppm.

4. The electroless copper plating composition of claim 1, wherein the one or more complexing agents are chosen from sodium potassium tartrate, sodium tartrate, sodium salicylate, sodium salts of ethylenediamine tetraacetic acid, nitriloacetic acid and its alkali metal salts, gluconic acid, gluconates, triethanolamine, modified ethylene diamine tetraacetic acids, s,s-ethylene diamine disuccinic acid and hydantoin and hydantoin derivatives.

5. The electroless copper plating composition of claim 1, wherein the one or more reducing agents are chosen from formaldehyde, formaldehyde precursors, formaldehyde derivatives, borohydrides, substituted borohydrides, boranes, saccharides, and hypophosphite.

6. A method of electroless copper plating comprising:

e) providing a substrate comprising a dielectric;

f) applying a catalyst to the substrate comprising the dielectric;

g) applying an electroless copper plating composition to the substrate comprising the dielectric, wherein the electroless copper plating composition comprises one or more sources of copper ions, S-carboxymethyl-L-cysteine, one or more complexing agents, one or more reducing agents, and, optionally, one or more pH adjusting agents, wherein a pH of the electroless copper plating composition is greater than 7; and h) electroless plating copper on the substrate comprising the dielectric with the electroless copper plating composition.

7. The method of claim 6, wherein the S-carboxymethyl-L-cysteine is in amounts of at least 0.5 ppm.

8. The method of claim 6, wherein the electroless copper plating composition is at 40° C. or less.

9. The method of claim 6, wherein the catalyst is a palladium catalyst.

* * * * *